US007198329B1

(12) United States Patent
Larson

(10) Patent No.: US 7,198,329 B1
(45) Date of Patent: Apr. 3, 2007

(54) HEIGHT ADJUSTABLE WORK CHAIR

(76) Inventor: John E. Larson, P.O. Box 1197, Hamilton, MT (US) 59840

( * ) Notice: Subject to any disclaimer, the term of this patent is extended or adjusted under 35 U.S.C. 154(b) by 240 days.

(21) Appl. No.: 10/973,764

(22) Filed: Oct. 25, 2004

Related U.S. Application Data

(60) Provisional application No. 60/513,787, filed on Oct. 23, 2003, provisional application No. 60/513,788, filed on Oct. 23, 2003.

(51) Int. Cl.
*A47C 1/00* (2006.01)

(52) U.S. Cl. ..... 297/344.18; 297/344.1; 297/344.12; 297/411.36; 297/411.35; 297/338; 248/157

(58) Field of Classification Search ..... 297/344.18, 297/344.19, 344.12, 344.1, 302.1, 300.1, 297/340, 452.1, 338, 411.36, 411.35; 248/157, 248/424
See application file for complete search history.

(56) References Cited

U.S. PATENT DOCUMENTS

| | | | | |
|---|---|---|---|---|
| 4,561,693 | A * | 12/1985 | Brownlie et al. | 297/300.5 |
| 5,009,467 | A * | 4/1991 | McCoy | 297/411.36 |
| 6,012,775 | A * | 1/2000 | Czarnecki | 297/344.13 |
| 6,213,552 | B1 * | 4/2001 | Miotto | 297/300.5 |
| 6,425,633 | B1 * | 7/2002 | Wilkerson et al. | 297/300.2 |
| 6,425,636 | B2 * | 7/2002 | Chen | 297/344.19 |
| 6,685,267 | B1 * | 2/2004 | Johnson et al. | 297/300.1 |
| 6,923,505 | B2 * | 8/2005 | Siminovitch et al. | 297/411.35 |

* cited by examiner

*Primary Examiner*—David R. Dunn
*Assistant Examiner*—Erika Garrett

(57) ABSTRACT

A height adjustable chair has an upper portion that moves relative to a lower portion. Push-off arm rests are provided so that a person need not leave the chair to adjust the seat height upwardly. A seated person can transfer their body weight to the push-off arm rests supported directly by the stationary lower portion while the seat is being adjusted upwardly.

30 Claims, 6 Drawing Sheets

HEIGHT ADJUSTABLE WORK CHAIR

CROSS-REFERENCE TO RELATED APPLICATIONS

The subject application claim the benefits of U.S. Provisional Application Ser. No. 60/513,787, filed Oct. 23, 2003 and U.S. Provisional Application Ser. No. 60/513,788, filed Oct. 23, 2003. These applications are herein incorporated by reference in their entirety.

BACKGROUND OF THE INVENTION

Height adjustable work chairs are standard in today's seated workplace environments. The most common height adjustment mechanism for work chairs utilizes a spring driven mechanism, most commonly, the locking gas spring. Since a spring driven height adjustment mechanism only powers the chair seat upwardly when the chair user reduces downward force to the spring which supports the chair seat, the maneuver for current chair design requires the chair user's legs to lift the chair user from the chair seat while the chair user awkwardly reaches with one hand to locate and lift an unmarked height adjustment lever which is usually located out of user's visual range, fashionably concealed beneath the chair seat. This puts the chair user in an awkward position, especially in a way that relates to positioning her or his height to a specific work task. And typically, the height adjustment lever is mixed in with other visually concealed and unmarked adjustment levers used to adjust seat tilt or backrest tilt, oftentimes occasioning the user to actuate the wrong lever. There is a need for some chair users performing certain tasks to adjust the height of their chair while remaining in a stable focused position on the chair. In a multiple user situation where several users share usage time on the same chair, the multi-user chair would need to be height adjusted for users of different body measurements. If, for example, the multi-user chair were used in a laboratory setting to seat multiple users at a microscope, it may sometimes be necessary for a user to adjust the height of the chair to obtain appropriate eye level for the ocular setting due to limitations of the ocular setting on the microscope. With chairs currently available, the awkward maneuver required for adjusting the height of the chair upwardly, more or less necessitates that the user speculate how far up to adjust the chair while employing trial and error to obtain the sought after adjustment. This current method usually requires more than one attempt to get it right. In other laboratory uses, when high stool type chairs are used to seat laboratory workers at counter height work surfaces, the chair needs to be adjusted at a height that oftentimes suspends a worker's feet above the floor rendering the worker unable to push her or his weight off the chair seat for further upward height adjustment. In this situation, the worker must jump off the chair, and while standing, adjust the chair upward, speculating at the needed height adjustment. Then the worker must climb back on the chair to see if the adjustment was on target, many times having to readjust the chair a second or third time. In office settings, this same inefficiency with current chair designs exists, but is less noticeable due to lesser functional requirements demanded by the work task, or by the worker. In various work settings height adjustable chairs allow a number of workers to use a specialized piece of equipment such as a drill press or assembly line machinery. Efficient upward height adjustment is not only necessary for worker efficiency, but also to allow the worker accurate adjustment of user's working height appropriate to the work equipment. In situations where chair height adjustment is needed, the most efficient and accurate upward adjustment of chair height is while the user is in the chair. An alternative for achieving the benefits of this invention would be the use of an expensive electric powered chair, attendant with power consumption costs, and the necessity of spatial support requirements related to power cord and/or battery weight, and battery recharging paraphernalia. There is a need for a relatively inexpensive height adjustable chair that provides a seated worker upward chair height adjustment while the worker remains as suitably disposed in the chair as possible to the work task to which the adjustment is being made.

All patents, patent applications, provisional patent applications and publications referred to or cited herein, are incorporated by reference in their entirety to the extent they are not inconsistent with the explicit teachings of the specification.

SUMMARY OF THE INVENTION

The invention involves height adjustable work chairs from which seated persons need not remove their body weight from the chair during upward height adjustment, that with current chair designs, would awkwardly position the person relative to the task to which the adjustment is being made. Push-off arm rests can support all or part of a user's weight independent of the height adjustment mechanism, allowing the chair seat to be adjusted upwardly. The chair has an upper portion that moves relative to a lower stationary portion supported on the floor. The push-off arm rests are directly connected to the lower portion allowing the body weight of the chair user to be transferred from the chair seat to the floor in a way that reduces downward force to the height adjustment mechanism without the necessity of user's feet depending contact with the floor surface, as is the requirement with current chair designs. In the most preferred embodiment, a remote actuation mechanism is mounted proximate one of the push-off arm rests which allow the chair user to actuate a spring loaded height adjustment mechanism while at the same time using the push-off arm rests to transfer user's body weight away from the spring loaded height adjustment mechanism which can then resiliently power the chair set upwardly.

DETAILED DESCRIPTION OF THE INVENTION

Figure 1:
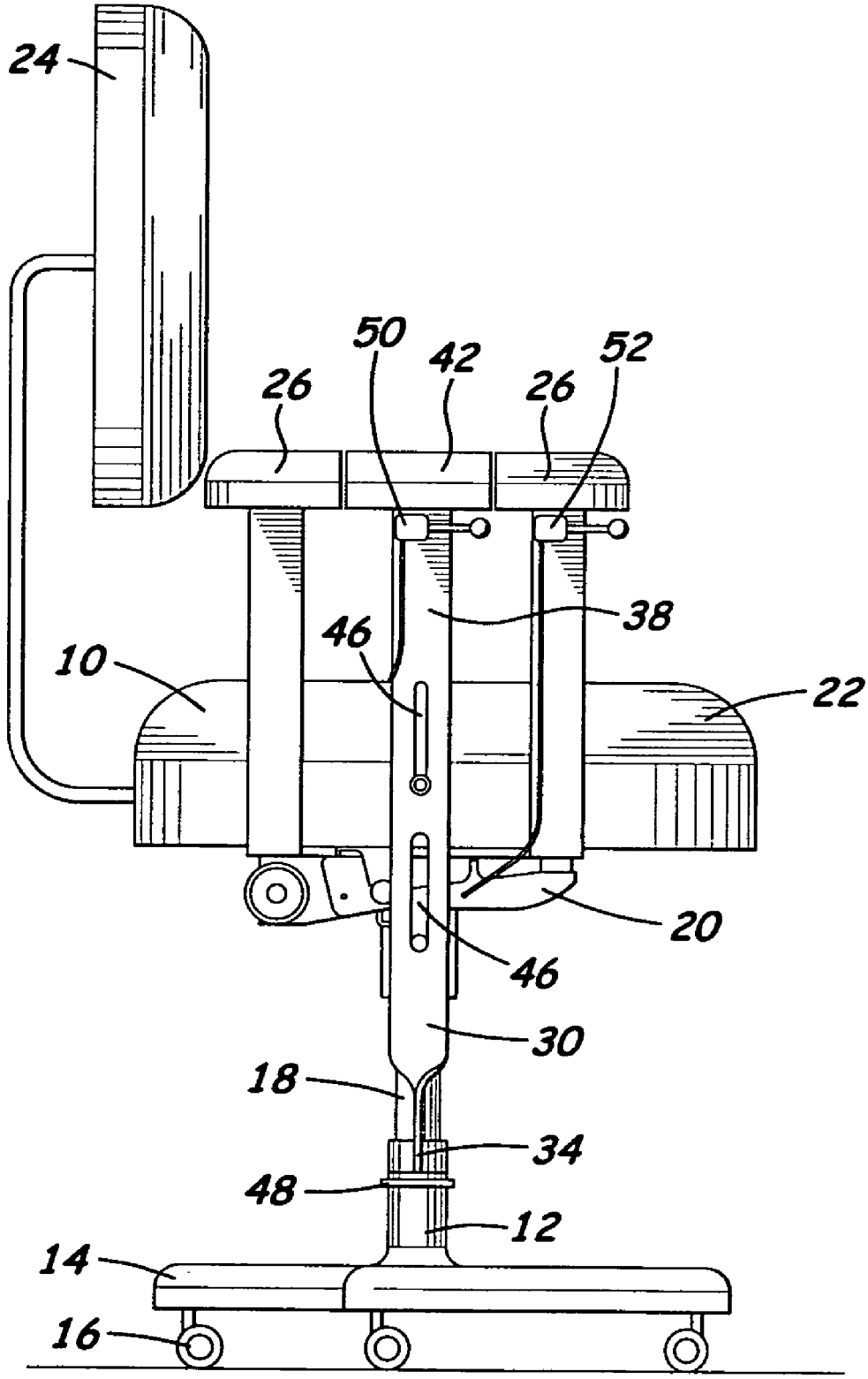
FIG. 1 shows a side view of a preferred embodiment of the height adjustable work chair of the subject invention.
Figure 2:
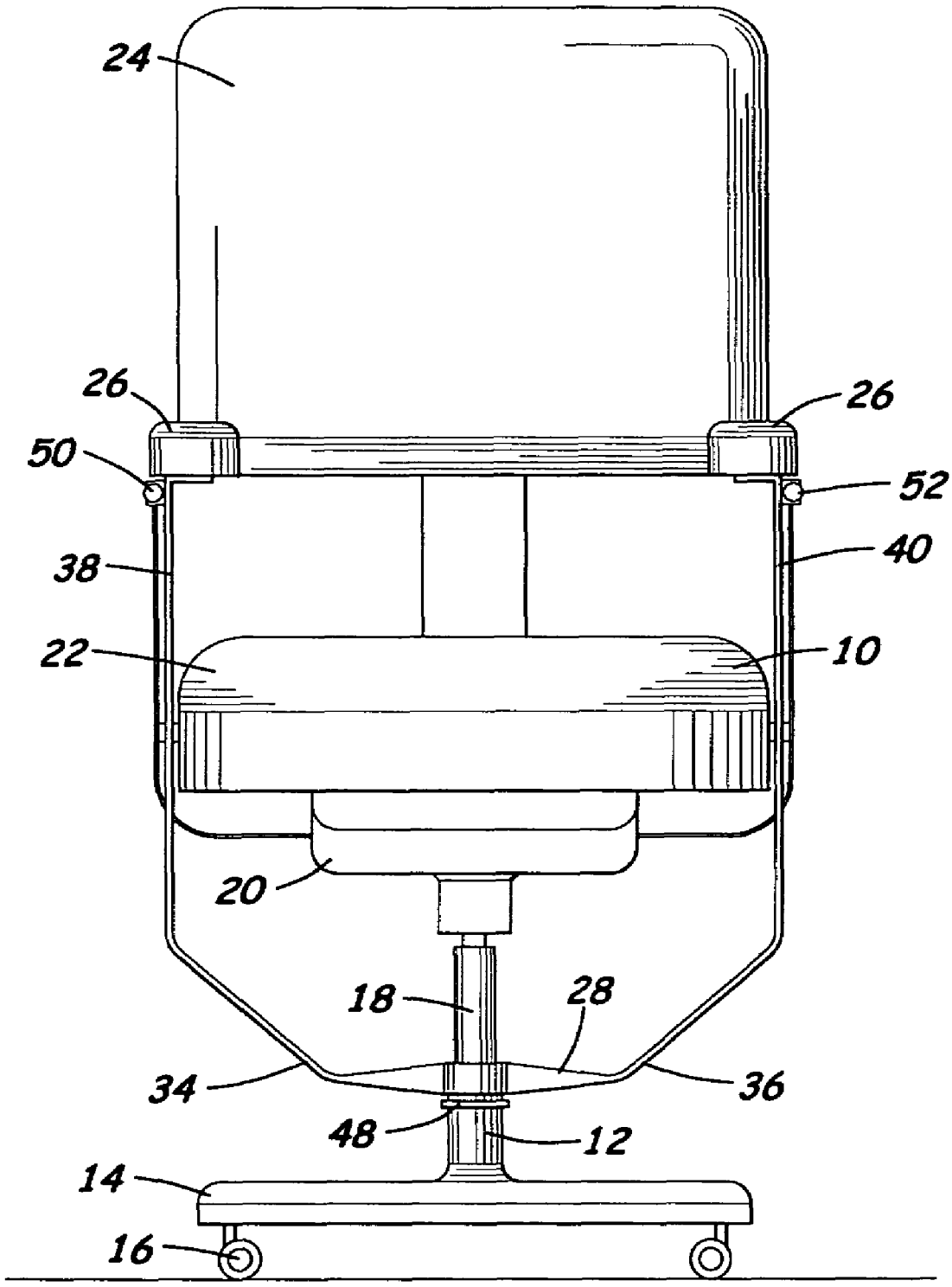
FIG. 2 shows a front view of the height adjustable work chair shown in FIG. 1.
Figure 3:
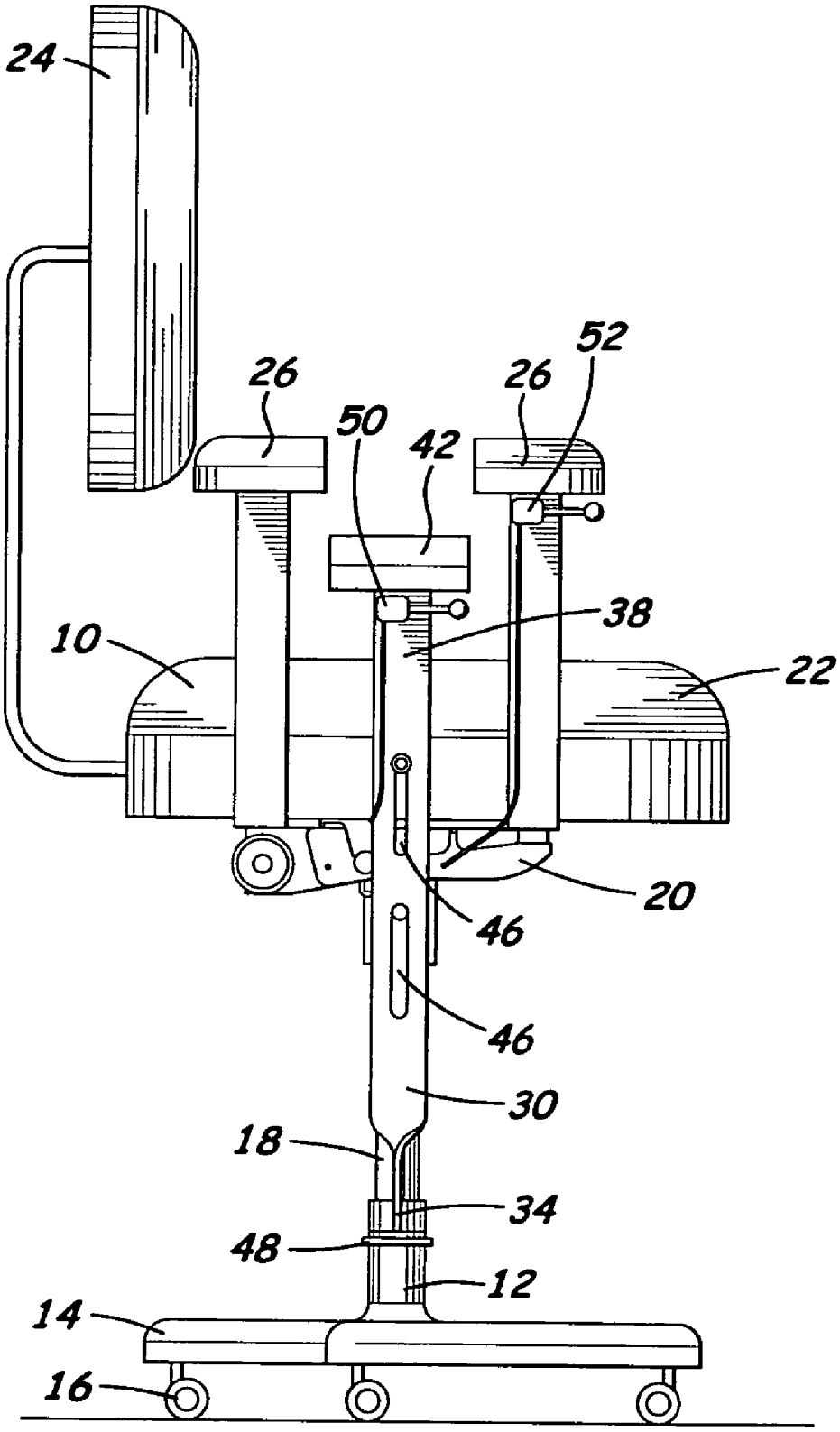
FIG. 3 shows a side view of the height adjustable work chair shown in FIG. 1 where the chair seat position has been adjusted upward.
Figure 4:
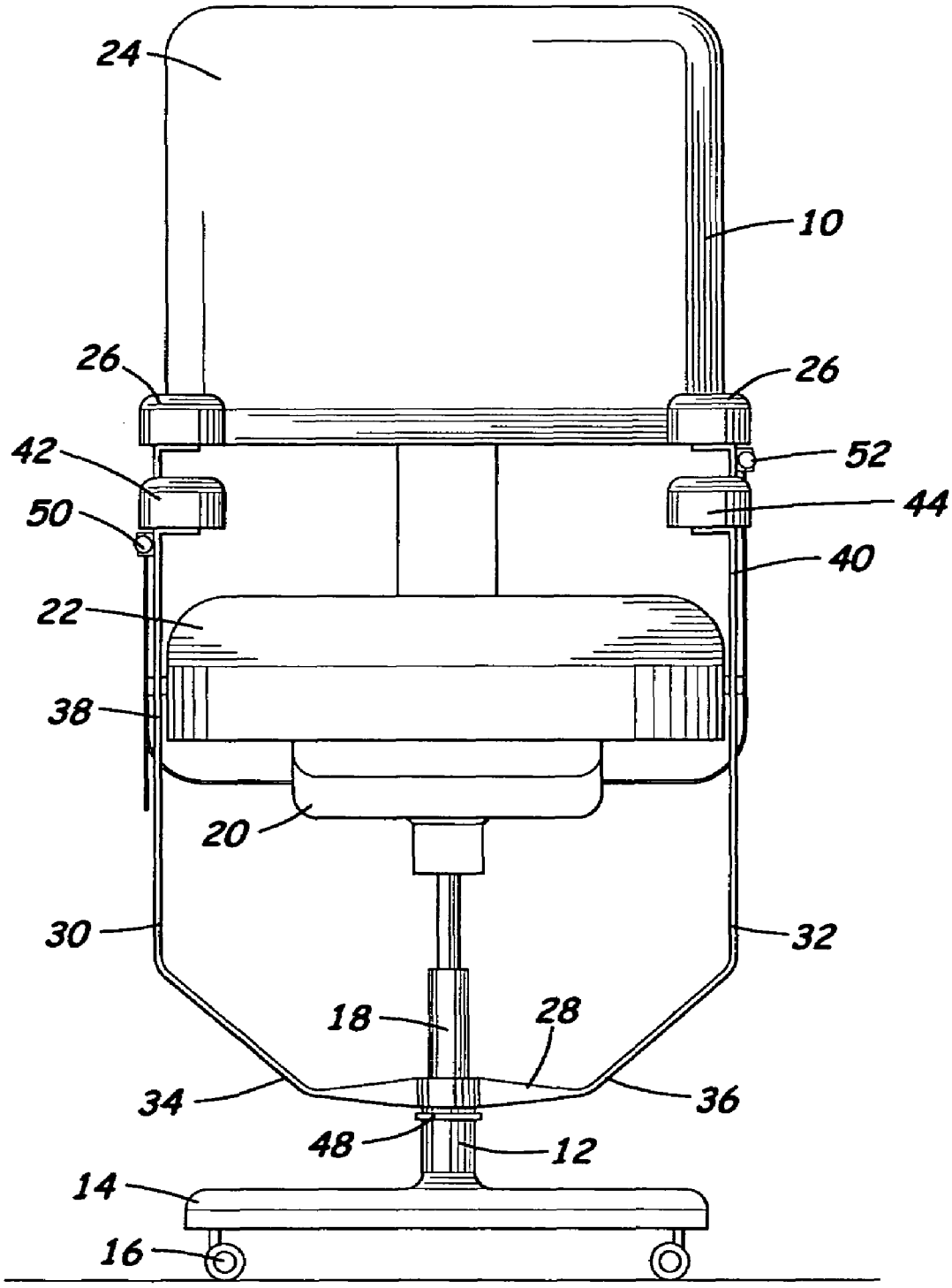
FIG. 4 shows a front view of the height adjustable work chair shown in FIG. 3.

Push-off arm rests allow a seated person to remove their weight from the chair seat so the position of the seat can be adjusted without the seated person having to stand or leave the chair.

A preferred embodiment of the height adjustable work chair is shown in FIGS. 1–4. The height adjustable work chair of the subject invention has a push-off arm rest which allows one seated on the chair to lift their weight off the chair seat so the seat can be raised. The chair has an upper portion 10 and a lower portion 12. The upper portion moves relative to the lower portion. The lower portion 12 includes a floor contacting base 14. In the exemplified embodiment, the base 14 has castors 16. The upper portion 10 moves relative to the lower portion 12 by a height adjustment mechanism 18. The height adjustment mechanism is supported by the base 14 and supports a seat support mechanism 20 which supports the seat 22 of the chair. The seat support mechanism 20 and the chair seat 22 move relative to the lower portion and therefore are part of the upper moving portion of the subject height adjustable chair. The upper portion 10 can further include a seat back 24 and arm rests 26.

Figure 5:
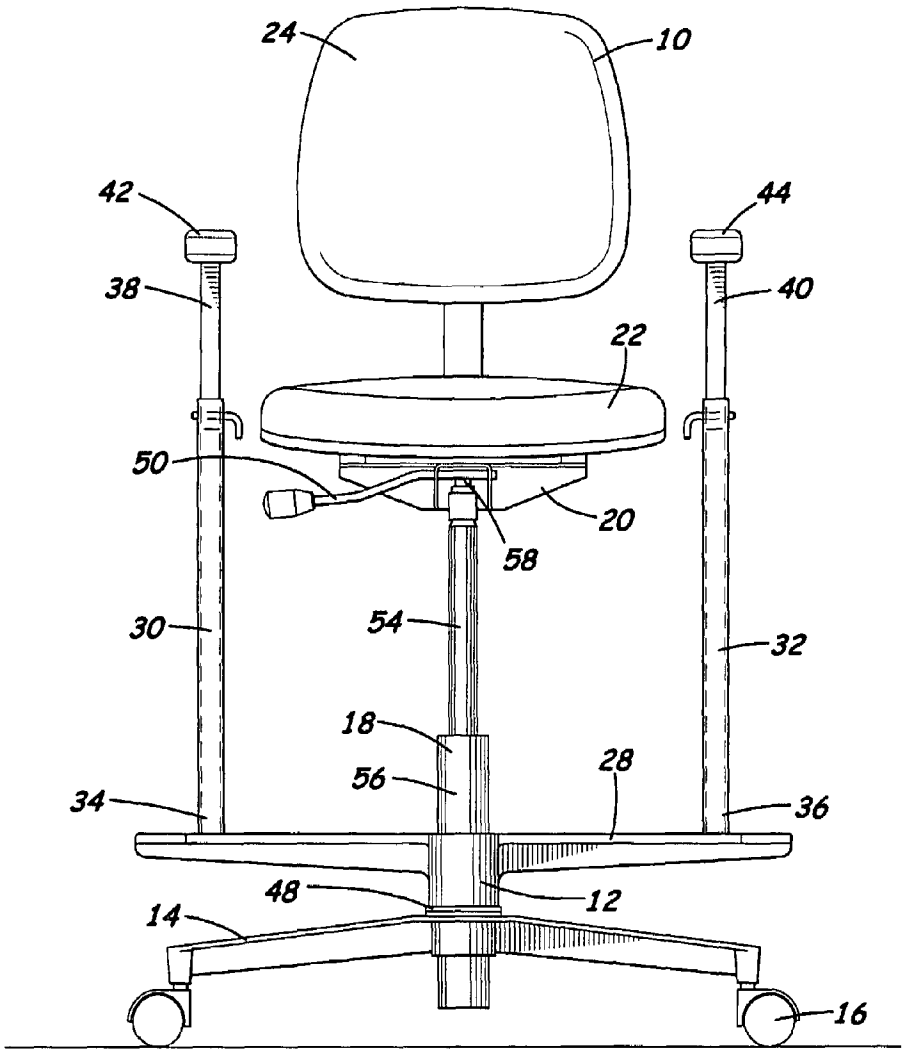
FIG. 5 shows another preferred embodiment of the height adjustable work chair of the subject invention with height adjustable push-off arm rests.

Push-off arm rests allow the body position of a person seated in the chair to be changed while the person's full body weight is supported by the height adjustable work chair. A push-off arm rest supporting mechanism is attached to the lower portion 12 of the chair. The push-off arm rest supporting mechanism 28 includes push-off arm rest supports 30, 32. A first end 34, 36 of each support 30, 32, respectively, is connected to the lower portion 12. A second end 38, 40 of each support 30, 32 has push-off arm rests 42, 44. The push-off arm rests remain stationary with the lower portion of the chair as the upper portion rises. In a particularly preferred embodiment, the push-off arm rests are height adjustable. The push-off arm rest supports 30, 32 allow the push-off arm rests 42, 44 to be adjusted relative to the push-off arm rest supporting mechanism 28 (FIG. 5). Additionally, the push-off arm rest supporting mechanism 28 can be detachable. Slots 46 allow upper portion components attached to the push-off arm rest supports to move as the upper portion rises. A swivel 48 allows the chair to rotate at any position.

Height adjustment mechanisms can be any suitable device that can move the upper portion relative to the lower portion. Examples include, but are not limited to, springs, telescoping supports, gas springs, and locking gas springs. In the embodiment shown in FIG. 5, a locking gas spring 54 supported by a stand tube 56 is actuated by contacting and moving an actuation button 58.

In the embodiment shown in FIGS. 1–4, an actuation mechanism 50 controls movement of the upper portion 12 relative to the lower portion 10. The actuation mechanism 50 can be any type suitable to control the height adjustable mechanism. In this embodiment, the height adjustable mechanism is a telescoping support with an upper section and a lower section which move in parallel alignment and can be locked into position. The actuation mechanism 50 controlling movement of these sections is a remote activating device using a lever and cable. An additional actuator 52 is shown on the chair in FIG. 1 and controls the tilt and positioning of the seat 22 and seat back 24.

Figure 6:
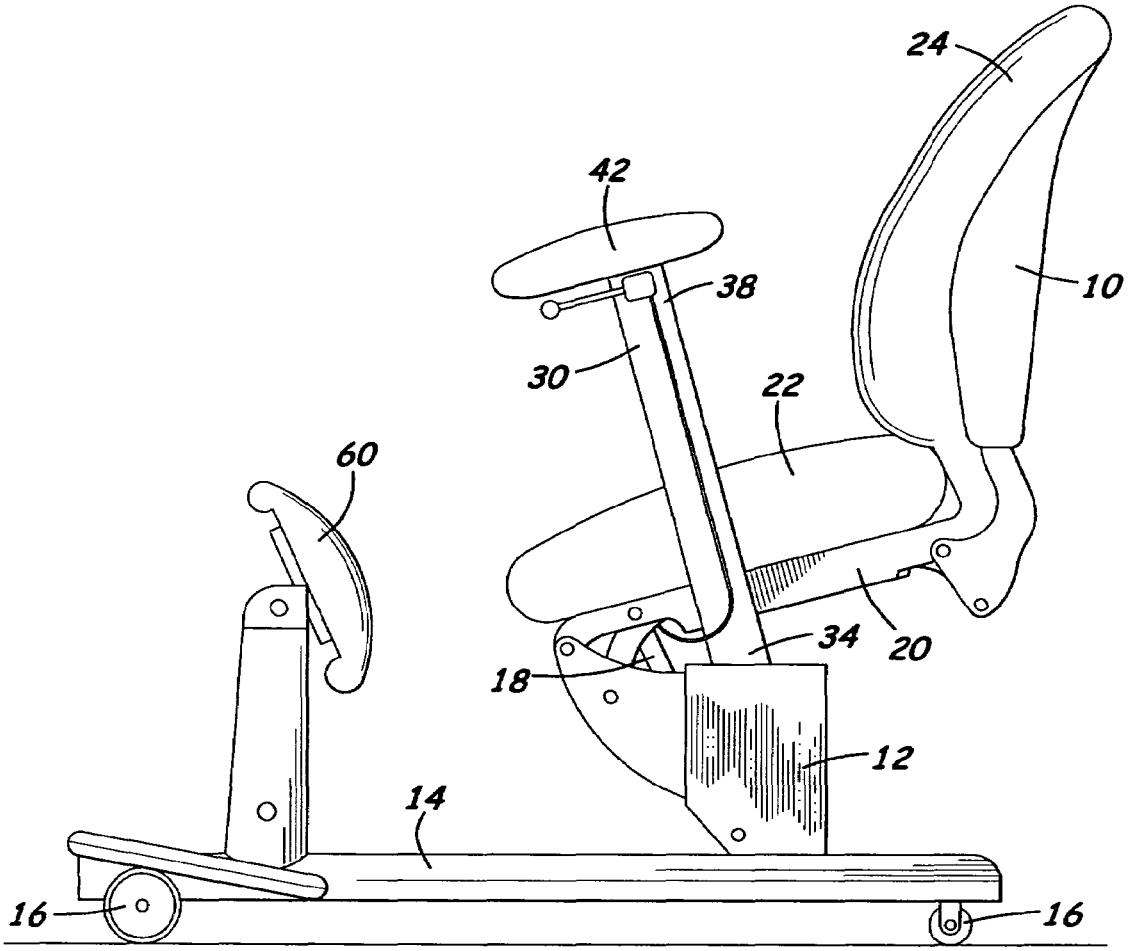
FIG. 6 shows another preferred embodiment of the height adjustable work chair of the subject invention.

FIG. 6 shows another preferred embodiment of the height adjustable chair of the subject invention. The chair (U.S. Pat. Nos. 6,439,657 and 6,702,372) includes an upper portion 10 that moves relative to a lower portion 12. The upper portion includes a seat support mechanism 20, a chair seat 22 and a seat back 24. The lower portion includes a base 14 on castors 16 and a pivoting knee pad 60. The push-off arm rests have a remote actuator 50 and are connected to the lower portion 12.

It is understood that the foregoing examples are merely illustrative of the present invention. Certain modifications of the devices and/or methods employed may be made and still achieve the objectives of the invention. Such modifications are contemplated as within the scope of the claimed invention.

The invention claimed is:

1. An height adjustable work chair comprising:

a floor contacting base;

a seat support mechanism disposed above said base and supported by said base;

a chair seat positioned above said seat support mechanism and supported by said seat support mechanism;

a height adjustment mechanism disposed between said base and said chair seat, wherein said height adjustment mechanism is supported by said base; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change position relative to said lower portion as a result of movement of said height adjustment mechanism; wherein said lower portion comprises at least said base; wherein said upper portion comprises at least said seat support mechanism and said chair seat;

at least one push-off arm rest support disposed above said base; wherein each push-off arm rest support comprises a first end; and a second end; wherein said first end of each push-off arm rest support can be secured to said lower portion; wherein said second end of each push-off arm rest support can be disposed above said chair seat;

a push-off arm rest supporting mechanism supported by said base; wherein said push-off arm rest supporting mechanism comprises at least one said push-off arm rest support; wherein at least one said push-off arm rest support extends upwardly from said push-off arm rest supporting mechanism; wherein said first end of at least one said push-off arm rest support is secured to said lower portion by said push-off arm rest supporting mechanism;

at least one push-off arm rest; wherein each push-off arm rest comprises the uppermost portion of said second end of each push-off arm rest support; wherein each push-off arm rest can comprise a user hand or user arm supporting surface; wherein a user seated in said height adjustable work chair can grip each push-off arm rest with user's hands and push down thereon to reduce user's body weight from said chair seat, and correspondingly transfer the downward force of user's body weight from said upper portion to said lower portion of said height adjustable work chair; wherein said height adjustment mechanism can be moved to extend upwardly with a correspondingly reduced upward force requirement, wherein the position of said chair seat can be moved to provide for a changed body position for user while user's full body weight is supported on said height adjustable work chair.

2. The height adjustable work chair of claim 1, wherein said height adjustment mechanism comprises at least one telescoping support mechanism which can be contracted and extended; wherein each telescoping support mechanism comprises a lower section supported by said base; and an upper section disposed in parallel alignment at least in part to its respective lower section; wherein each upper section of each telescoping support mechanism can move, toward and away from, its respective lower section; wherein said seat support mechanism secures said upper section of at least one said telescoping support mechanism to said chair seat.

3. The height adjustable work chair of claim 1, wherein said height adjustment mechanism comprises a lockable height adjustment column comprising means whereby said height adjustment column can be locked and unlocked; wherein said lockable height adjustment column extends longitudinally between said base and said chair seat, wherein said lockable height adjustment column comprises an upper section and a lower section; wherein said lower section is supported by said base and is secured to said lower portion; wherein at least said upper section comprises said upper portion and can move upwardly and downwardly relative to said lower section; wherein said seat support mechanism secures said chair seat to said upper section of said height adjustment column.

4. The height adjustable work chair of claim 3, wherein said means for locking and unlocking said lockable height adjustment column comprise a movable actuation button; wherein said movable actuation button can be selectively moved from a locked position where said upper and lower sections comprising said lockable height adjustment column cannot move toward or away from each other, to an unlocked position where said upper and lower sections comprising said lockable height adjustment column can move toward or away from each other, wherein said height adjustment column can be actuated.

5. The height adjustable work chair of claim 1, wherein said height adjustment mechanism comprises a height adjustment column comprising at least one telescoping support mechanism which can be contracted and extended; wherein each telescoping support mechanism comprises a lower section supported by said base; and an upper section disposed in parallel alignment at least in part to its each respective lower section; wherein each upper section of each telescoping support mechanism can move longitudinally in parallel alignment at least in part, toward and away from, its respective lower section; wherein said seat support mechanism secures said upper section of each telescoping support mechanism to said chair seat; wherein each upper section of each telescoping support mechanism comprises said upper portion of said height adjustable work chair; and wherein at least one said lower section is secured to said lower portion of said height adjustable work chair.

6. The height adjustable work chair of claim 5, comprising at least one stand tube disposed above said base and supported by said base and comprising said lower portion; wherein at least one said telescoping support mechanism is supported one said stand tube; wherein said second section of at least one said telescoping support mechanism extends between one said stand tube and said seat support mechanism.

7. The height adjustable work chair of claim 1, comprising means to lock and unlock said upper and lower portions of said height adjustable work chair; wherein when locked, relative change in elevation of said upper portion relative to said lower portion can be prevented, and when unlocked, relative change in elevation of said upper portion relative to said lower portion can be allowed; wherein said means comprises an actuation mechanism.

8. The height adjustment work chair claim 1, comprising means to lock and unlock said upper and lower portions of said height adjustable work chair; wherein when locked, relative change in elevation between said upper portion and said lower portion can be prevented, and when unlocked, relative change in elevation between said upper portion and said lower portion can be allowed; wherein said means comprises a remote actuation mechanism;

wherein said remote actuation mechanism is supported on said second end of one said push-off arm rest support proximate said push-off arm rest, wherein a user supported by said height adjustable work chair can reach and move said remote actuation mechanism with one hand while keeping each hand on one said push-off arm rest.

9. The height adjustable work chair of claim 1, wherein said height adjustment mechanism comprises a movable resilient spring material; wherein when said upper portion of said height adjustable work chair is moved toward said lower portion with sufficient force, said resilient spring material can be resiliently moved, wherein absent sufficient force, said resilient spring material can resiliently move resulting in moving said second portion away from said first portion, resulting in moving said seat support mechanism and correspondingly moving said chair seat relative to said base.

10. The height adjustable work chair of claim 1, wherein said height adjustment mechanism comprises at least one spring; wherein each spring comprises a movable resilient spring material and; wherein at least one said spring comprises a non-locking gas spring; wherein said non-locking gas spring comprises first and second telescoping sections; wherein said first section comprises a cylinder, and said second section comprises a piston rod disposed within said cylinder extending outwardly therefrom; wherein said non-locking gas spring is disposed above said base and is supported by said base; wherein at least one of said first or said second sections comprises said upper portion; wherein said movable spring material comprises pressurized gas disposed within said cylinder; and a fluid flow valve disposed within said cylinder.

11. The height adjustable work chair of claim 1, wherein said height adjustment mechanism comprises at least one spring; wherein each spring comprises a movable resilient spring material and; wherein at least one said spring comprises a locking gas spring; wherein said locking gas spring comprises first and second telescoping sections; wherein said first section comprises a cylinder, and said second section comprises a piston rod disposed within said cylinder extending outwardly therefrom; wherein said locking gas spring is disposed above said base and is supported by said base; wherein one of said first or said second sections comprises said upper portion; wherein said movable spring material comprises pressurized gas disposed within said cylinder; and a movable fluid flow control valve stem extending outwardly from said locking gas spring; and an actuation button comprising an end comprising said outwardly extending movable fluid flow control valve stem; wherein said actuation button can be moved from a first locked position to a second unlocked position wherein said locking gas spring is actuated; wherein said unlocked position allows relative longitudinal movement between said cylinder and said piston rod, wherein said locking gas spring is actuated;

an actuation mechanism for moving said actuation button.

12. The height adjustable work chair of claim 11, wherein said height adjustable work chair comprises a remote activating device for moving said actuation mechanism and thereby said actuation button; wherein said remote activating device comprises first and second ends extendibly connected by a cable; wherein said first end comprises said actuation mechanism and is disposed proximate said actuation button; wherein said second end comprises an actuator and is secured on said upper end of one said push-off arm rest support proximate one said arm rest; wherein moving said actuator can cause said actuation mechanism to move said actuation button; wherein a user sitting on said chair seat can reach and move said actuator with one hand while keeping each hand on one said push-off arm rest; wherein moving said actuator can cause said height adjustment mechanism to move, which can change the position of said chair seat relative to said base.

13. The height adjustable work chair of claim 1, wherein at least one said push-off arm rest support comprises upper and lower telescoping sections; and a locking means; wherein at least one said upper section can be adjusted upwardly and downwardly relative to its respective lower section; and wherein said upper and lower sections of at least one said push-off arm rest support can be locked against said relative movement.

14. The height adjustable work chair of claim 1, wherein said seat support mechanism comprises means for slideably securing said seat support mechanism to at least one said push-off arm rest support thereby allowing aligned upward and downward movement of said seat support mechanism relative to at least one said push-off arm rest support; wherein said seat support mechanism is prevented from rotating relative to at least one said push-off arm rest support.

15. The height adjustable work chair of claim 1, wherein said chair seat is slideably secured to at least one said push-off arm rest support thereby allowing aligned upward and downward movement of said chair seat relative to at least one said push-off arm rest support; wherein said chair seat is prevented from rotating relative to at least one said push-off arm rest support.

16. The height adjustable work chair of claim 1, wherein said push-off arm rest supporting mechanism is rotably secured to said lower portion; wherein at least one said push-off arm rest support can rotate relative to said lower portion.

17. The height adjustment work chair of claim 16, comprising means for locking said push-off arm rest supporting mechanism; wherein said push-off arm rest supporting mechanism can be locked against rotation relative to said lower portion.

18. The height adjustable work chair of claim 1, comprising anti-rotation means for preventing said upper portion from rotating relative to said lower portion.

19. The height adjustable work chair of claim 1, wherein at least one said push-off arm rest support is detachable from said height adjustable work chair.

20. The height adjustable work chair of claim 1, wherein said push-off arm rest supporting mechanism is detachable from said height adjustable work chair.

21. The height adjustable work chair of claim 1, comprising at least one arm rest support; wherein said arm rest support comprises a lower end supported by said upper portion; and an upper end disposed above said chair seat; wherein said upper end comprises an arm rest disposed above said chair seat.

22. The height adjustable work chair of claim 21, wherein at least one arm rest support comprises a remote actuation mechanism.

23. The height adjustable work chair of claim 1, wherein said height adjustment mechanism comprises at least one telescoping support mechanism which can be contracted and extended; wherein each telescoping support mechanism comprises a lower section supported by said base; and an upper section disposed in parallel alignment at least in part to its respective lower section; wherein each upper section of each telescoping support mechanism can move, toward and away from, its respective lower section.

24. The height adjustable work chair of claim 1, wherein said height adjustment mechanism comprises at least one telescoping support mechanism extending longitudinally between said base and said seat support mechanism, which can be contracted and extended; wherein each telescoping support mechanism comprises a lower section supported by said base; and an upper section disposed in parallel alignment at least in part to its respective lower section; wherein each upper section of each telescoping support mechanism can move longitudinally in parallel alignment at least in part, toward and away from, its respective lower section; wherein said seat support mechanism secures said upper section of each telescoping support mechanism to said chair seat; wherein each upper section of each telescoping support mechanism comprises said upper portion of said height adjustable work chair; and wherein at least one said lower section is secured to said lower portion of said height adjustable work chair.

25. The height adjustable work chair of claim 1, wherein said height adjustment mechanism comprises at least one telescoping support mechanism extending longitudinally between said base and said seat support mechanism, which can be contracted and extended; wherein each telescoping support mechanism comprises a lower section supported by said base; and an upper section disposed in parallel alignment at least in part to its respective lower section; wherein each upper section of each telescoping support mechanism can move longitudinally in parallel alignment at least in part, toward and away from, its respective lower section; wherein said seat support mechanism secures said upper section of each telescoping support mechanism to said chair seat; wherein each upper section of each telescoping support mechanism comprises said upper portion of said height adjustable work chair; and wherein at least one said lower section is fixedly secured to, and comprises, said lower portion of said height adjustable work chair.

26. An height adjustable work chair comprising:

a floor contacting base;

a seat support mechanism disposed above said base and supported by said base;

a chair seat positioned above said seat support mechanism and supported by said seat support mechanism;

a height adjustment mechanism disposed between said base and said chair seat, wherein said height adjustment mechanism is supported by said base and extends vertically therefrom; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change position relative to said lower portion as a result of movement of said height adjustment mechanism; wherein said lower portion comprises at least said base; wherein said upper portion comprises at least said seat support mechanism and said chair seat;

at least one push-off arm rest support disposed above said base; wherein each push-off arm rest support comprises a first end; and a second end; wherein said first end of each push-off arm rest support can be secured to said lower portion; wherein said second end of each push-off arm rest support can be disposed above said chair seat;

a push-off arm rest supporting mechanism supported by said base; wherein said push-off arm rest supporting mechanism comprises at least one said push-off arm rest support; wherein at least one said push-off arm rest support extends upwardly from said push-off arm rest supporting mechanism; wherein said first end of at least one said push-off arm rest support is secured to said lower portion by said push-off arm rest supporting mechanism;

at least one push-off arm rest; wherein each push-off arm rest comprises the uppermost portion of said second end of each push-off arm rest support; wherein each push-off arm rest can comprise a user hand or user arm supporting surface; wherein a user seated in said height adjustable work chair can grip each push-off arm rest with user's hands and push down thereon to reduce user's body weight from said chair seat, and correspondingly transfer the downward force of user's body weight from said upper portion to said lower portion of said height adjustable work chair; wherein said height adjustment mechanism can be moved to extend upwardly with a correspondingly lowered upward force requirement, wherein the position of said chair seat can be moved to provide for a changed body position for user while user's full body weight is supported on said height adjustable work chair;

wherein said height adjustment mechanism comprises a height adjustment column comprising at least one telescoping support mechanism comprising an upper section and at least one lower section, wherein said height adjustment column can be contracted and extended; wherein each telescoping support mechanism comprises one said lower section supported by said base; and an upper section disposed in parallel alignment at least in part to at least one said lower section; wherein each upper section of each telescoping support mechanism can move longitudinally in parallel alignment at least in part, toward and away from, one said lower section; wherein said seat support mechanism secures said upper section of at least one telescoping support mechanism to said chair seat; wherein each upper section of each telescoping support mechanism comprises said upper portion of said height adjustable work chair; and wherein at least one said lower section is secured to said lower portion of said height adjustable work chair; wherein said height adjustment column comprises at least one vertically disposed stand tube fixedly secured to said base and comprising one said lower section and said lower portion; wherein at least one said telescoping support mechanism is vertically supported by one said stand tube, wherein at least one said telescoping support mechanism extends vertically from said base; wherein said second section of at least one said telescoping support mechanism extends between said one said stand tube and said seat support mechanism.

27. An height adjustable work chair comprising:

a floor contacting base;

a seat support mechanism disposed above said base and supported by said base;

a chair seat positioned above said seat support mechanism and supported by said seat support mechanism;

a height adjustment mechanism disposed between said base and said chair seat, wherein said height adjustment mechanism is supported by said base; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change position relative to said lower portion as a result of movement of said height adjustment mechanism; wherein said lower portion comprises at least said base; wherein said upper portion comprises at least said seat support mechanism and said chair seat;

at least one push-off arm rest support disposed above said base; wherein each push-off arm rest support comprises a first end; and a second end; wherein said first end of each push-off arm rest support can be secured to said lower portion; wherein said second end of each push-off arm rest support can be disposed above said chair seat;

a push-off arm rest supporting mechanism supported by said base; wherein said push-off arm rest supporting mechanism comprises at least one said push-off arm rest support; wherein at least one said push-off arm rest support extends upwardly from said push-off arm rest supporting mechanism; wherein said first end of at least one said push-off arm rest support is secured to said lower portion by said push-off arm rest supporting mechanism;

at least one push-off arm rest; wherein each push-off arm rest comprises the uppermost portion of said second end of each push-off arm rest support; wherein each push-off arm rest can comprise a user hand or user arm supporting surface; wherein a user seated in said height adjustable work chair can grip each push-off arm rest with user's hands and push down thereon to reduce user's body weight from said chair seat, and correspondingly transfer the downward force of user's body weight from said upper portion to said lower portion of said height adjustable work chair; wherein said height adjustment mechanism can be moved to extend upwardly with a correspondingly lowered upward force requirement, wherein the position of said chair seat can be moved to provide for a changed body position for user while user's full body weight is supported on said height adjustable work chair;

wherein said height adjustment mechanism comprises at least one telescoping support mechanism which can be contracted and extended; wherein each telescoping support mechanism comprises a lower section supported by said base; and an upper section disposed in parallel alignment at least in part to its respective lower section; wherein each upper section of each telescoping support mechanism can move, toward and away from, its respective lower section; wherein said seat support mechanism secures said upper section of at least one said telescoping support mechanism to said chair seat and; wherein at least one said lower section is secured to said lower portion.

28. An height adjustable work chair comprising:

a floor contacting base;

a seat support mechanism disposed above said base and supported by said base;

a chair seat positioned above seat support mechanism and supported by said seat support mechanism;

a height adjustment mechanism disposed between said base and said chair seat, wherein said height adjustment mechanism is supported by said base and extends vertically therefrom; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change height relative to said lower portion as a result of movement of said height adjustment mechanism; wherein said lower portion comprises at least said base; wherein said upper portion comprises at least said seat support mechanism and said chair seat;

wherein said height adjustment mechanism comprises a height adjustment column comprising at least one telescoping support mechanism comprising an upper section and at least one lower section, wherein said height adjustment column can be contracted and extended; wherein each telescoping support mechanism comprises one said lower section supported by said base; and an upper section disposed in parallel alignment at least in part to at least one said lower section; wherein each upper section of each telescoping support mechanism can move longitudinally in parallel alignment at least in part, toward and away from, at least one said lower section; wherein said seat support mechanism secures said upper section of each telescoping support mechanism to said chair seat; wherein each upper section of each telescoping support mechanism comprises said upper portion of said height adjustable work chair; and wherein at least one said lower section is secured to said lower portion of said height adjustable work chair;

wherein said height adjustment mechanism comprises at least one spring; wherein each spring comprises a movable resilient spring material and; wherein at least one said spring comprises a locking gas spring; wherein said locking gas spring comprises first and second telescoping sections; wherein said first section comprises a cylinder, and said second section comprises a piston rod disposed within said cylinder extending outwardly therefrom; wherein said locking gas spring is disposed above said base and is supported by said base; wherein one of said first or said second sections comprises said upper portion; wherein said movable spring material comprises pressurized gas disposed within said cylinder; and a movable fluid flow control valve stem extending outwardly from said locking gas spring; and an actuation button comprising an end comprising said outwardly extending movable fluid flow control valve stem; wherein said actuation button can be moved from a first locked position to a second unlocked position wherein said locking gas spring is actuated; wherein said unlocked position allows relative longitudinal movement between said cylinder and said piston rod, wherein said locking gas spring is actuated;

wherein said height adjustment column comprises at least one vertically disposed stand tube fixedly secured to said base and comprising one said lower section and said lower portion; wherein at least one said telescoping support mechanism is vertically supported by one said stand tube, wherein at least one said telescoping support mechanism extends vertically from said base; wherein said second section of at least one said telescoping support mechanism extends between said one said stand tube and said seat support mechanism;

at least one arm rest support; wherein said arm rest support comprises a lower end supported by said upper portion; and an upper end disposed above said chair seat;

at least one arm rest; wherein each arm rest comprises the uppermost portion of said upper end of each arm rest support; wherein each arm rest comprises a user hand or user arm supporting surface;

an actuation mechanism for moving said actuation button; wherein said actuation mechanism can comprise a lever;

a remote activating device for moving said actuation mechanism; wherein said remote activating device comprises first and second ends extendibly connected by a cable; wherein said first end comprises said actuation mechanism and is disposed proximate said actuation button; wherein said second end comprises an actuator and is secured on said upper end of one said arm rest support proximate one said arm rest; wherein moving said actuator can cause said actuation mechanism to move said actuation button; wherein a user sitting on said chair seat can reach and move said actuator with one hand while keeping each hand on one said arm rest; wherein moving said actuator can cause said height adjustment mechanism to move, which can change the position of said chair seat relative to said base.

29. An height adjustable work chair comprising:

a floor contacting base;

a seat support mechanism disposed above said base and supported by said base;

a chair seat positioned above said seat support mechanism and supported by said seat support mechanism;

a height adjustment mechanism disposed between said base and said chair seat, wherein said height adjustment mechanism is supported by said base and extends vertically therefrom; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change position relative to said lower portion as a result of movement of said height adjustment mechanism; wherein said lower portion comprises at least said base; wherein said upper portion comprises at least said seat support mechanism and said chair seat;

at least one push-off arm rest support disposed above said base; wherein each push-off arm rest support comprises a first end; and a second end; wherein at least said first end of each push-off arm rest support comprises said lower portion; wherein said second end of each push-off arm rest support can be disposed above said chair seat;

at least one push-off arm rest; wherein each push-off arm rest comprises the uppermost portion of said second end of each push-off arm rest support; wherein each push-off arm rest can comprise a user hand or user arm supporting surface; wherein a user seated in said height adjustable work chair can grip each push-off arm rest with user's hands and push down thereon to reduce user's body weight from said chair seat, and correspondingly transfer the downward force of user's body weight from said upper portion to said lower portion of said height adjustable work chair; wherein said height adjustment mechanism can be moved to extend upwardly with a correspondingly lowered upward force requirement, wherein the position of said chair seat can be moved to provide for a changed body position for user while user's full body weight is supported on said height adjustable work chair;

wherein said height adjustment mechanism comprises a height adjustment column comprising at least one telescoping support mechanism comprising an upper section and at least one lower section, wherein said height adjustment column can be contracted and extended; wherein each telescoping support mechanism comprises one said lower section supported by said base; and an upper section disposed in parallel alignment at least in part to at least one said lower section; wherein each upper section of each telescoping support mechanism can move longitudinally in parallel alignment at least in part, toward and away from, one said lower section; wherein said seat support mechanism secures said upper section of at least one telescoping support mechanism to said chair seat; wherein each upper section of each telescoping support mechanism comprises said upper portion of said height adjustable work chair; and wherein at least one said lower section is secured to said lower portion of said height adjustable work chair; wherein said height adjustment column comprises at least one vertically disposed stand tube fixedly secured to said base and comprising one said lower section and said lower portion; wherein at least one said telescoping support mechanism is vertically supported by one said stand tube, wherein at least one said telescoping support mechanism extends vertically from said base; wherein said second section of at least one said telescoping support mechanism extends between said one said stand tube and said seat support mechanism.

30. An height adjustable work chair comprising:

a floor contacting base;

a seat support mechanism disposed above said base and supported by said base;

a chair seat positioned above said seat support mechanism and supported by said seat support mechanism;

a height adjustment mechanism disposed between said base and said chair seat, wherein said height adjustment mechanism is supported by said base; wherein said chair seat is supported by said height adjustment mechanism; wherein said height adjustment mechanism can move; wherein movement of said height adjustment mechanism can result in changing the position of said chair seat relative to said base;

wherein said seat support mechanism is supported by said height adjustment mechanism; and secures said chair seat to said height adjustment mechanism;

wherein said height adjustable work chair comprises a lower portion; and an upper portion disposed above said lower portion and supported by said lower portion; wherein the position of said upper portion can be changed relative to said lower portion; wherein said upper portion comprises any and all components comprising said height adjustable work chair that can change position relative to said lower portion as a result of movement of said height adjustment mechanism; wherein said lower portion comprises at least said base; wherein said upper portion comprises at least said seat support mechanism and said chair seat;

at least one push-off arm rest support disposed above said base; wherein each push-off arm rest support comprises a first end; and a second end; wherein at least said first end of each push-off arm rest support comprises said lower portion; wherein said second end of each push-off arm rest support can be disposed above said chair seat;

at least one push-off arm rest; wherein each push-off arm rest comprises the uppermost portion of said second end of each push-off arm rest support; wherein each push-off arm rest can comprise a user hand or user arm supporting surface; wherein a user seated in said height adjustable work chair can grip each push-off arm rest with user's hands and push down thereon to reduce user's body weight from said chair seat, and correspondingly transfer the downward force of user's body weight from said upper portion to said lower portion of said height adjustable work chair; wherein said height adjustment mechanism can be moved to extend upwardly with a correspondingly lowered upward force requirement, wherein the position of said chair seat can be moved to provide for a changed body position for user while user's full body weight is supported on said height adjustable work chair;

wherein said height adjustment mechanism comprises at least one telescoping support mechanism which can be contracted and extended; wherein each telescoping support mechanism comprises a lower section supported by said base; and an upper section disposed in parallel alignment at least in part to its respective lower section; wherein said chair seat is supported by said telescoping support mechanism; wherein said telescoping support mechanism comprises a movable resilient spring material;

a knee rest supporting mechanism extending upwardly above said base and attached to said lower portion;

a knee rest disposed on said knee rest supporting mechanism for supporting the lower leg of a user when user is supported on said chair seat.

* * * * *